US007951014B2

(12) United States Patent
Nickel

(10) Patent No.: US 7,951,014 B2
(45) Date of Patent: May 31, 2011

(54) DEVICE FOR PICKING UP GOLF BALLS

(76) Inventor: Werner Nickel, Keltern-Dietlingen (DE)

( * ) Notice: Subject to any disclaimer, the term of this patent is extended or adjusted under 35 U.S.C. 154(b) by 187 days.

(21) Appl. No.: 12/265,056

(22) Filed: Nov. 5, 2008

(65) Prior Publication Data

US 2009/0149270 A1 Jun. 11, 2009

Related U.S. Application Data

(60) Provisional application No. 61/014,895, filed on Dec. 19, 2007.

(30) Foreign Application Priority Data

Nov. 6, 2007 (DE) ..... 10 2007 052 718

(51) Int. Cl.
*A63B 47/02* (2006.01)

(52) U.S. Cl. ..... 473/286; 294/19.2

(58) Field of Classification Search ..... 473/286; 294/19.2

See application file for complete search history.

(56) References Cited

U.S. PATENT DOCUMENTS

| | | | | |
|---|---|---|---|---|
| 802,264 A | | 10/1905 | Brown | |
| 1,626,967 A | * | 5/1927 | Reach | 473/298 |
| 1,658,145 A | | 2/1928 | Uyei | |
| 1,701,856 A | * | 2/1929 | Kraeuter | 473/300 |
| 2,583,198 A | * | 1/1952 | Axton, Jr | 473/549 |
| 2,801,875 A | * | 8/1957 | Mcevoy | 294/19.2 |
| 2,834,629 A | * | 5/1958 | Williams | 294/19.2 |
| 3,318,628 A | * | 5/1967 | White | 294/19.2 |
| 3,698,720 A | * | 10/1972 | Gudmundsen | 473/286 |
| 7,351,156 B1 | * | 4/2008 | Panneri et al. | 473/132 |
| 7,384,347 B2 | * | 6/2008 | Milne | 473/286 |
| 2003/0236129 A1 | * | 12/2003 | Pettinga et al. | 473/286 |
| 2007/0010345 A1 | * | 1/2007 | Milne | 473/286 |

FOREIGN PATENT DOCUMENTS

| | | |
|---|---|---|
| EP | 0453120 B1 | 4/1991 |
| EP | 1 208 877 A1 | 5/2002 |
| WO | WO 2005028036 A1 | 9/2004 |

OTHER PUBLICATIONS

The Random House College Dictionary (Revised Edition, 1975), p. 118, Definition 17 of "bear", p. 699, Definition 2 "into".*

* cited by examiner

*Primary Examiner* — Stephen L. Blau
(74) *Attorney, Agent, or Firm* — Cantor Colburn LLP

(57) ABSTRACT

A device for picking up balls or golf balls (10) is disposed in the region of the grip (11) of a club (12). It includes several holding elements, which are displaceable under the effect of at least one resilient element from a rest position on the grip into an actuatable position in which they are capable of picking up the golf ball. By the holding element being at least two gripping arms (13, 14), which are fitted into each other in the rest position under the effect of at least one resilient element, a compact device for picking up that is simple to operate is created.

32 Claims, 3 Drawing Sheets

DEVICE FOR PICKING UP GOLF BALLS

REFERENCE TO RELATED APPLICATIONS

This application is related to and claims priority to German Patent Application 10 2007 052 718.9, filed on Nov. 6, 2007, and U.S. Provisional Patent Application No. 61/014,895, filed on Dec. 19, 2007. The entire contents of both the German Patent Application 10 2007 052 718.9 and U.S. Provisional Patent Application No. 61/014,895 are incorporated by reference herein.

FIELD OF THE INVENTION

The invention relates to a device for picking up golf balls, the device being disposed or installed in the region of a grip of a golf club in accordance with claim 1 and a golf club that is provided therewith in accordance with claim 17.

STATE OF THE ART

Ball games, and in particular the game of golf, are basically restful games that can be played by players with extremely varying ages and with various levels of physical fitness. Nevertheless, in principle, in the case of all these games it is necessary to pick up the playing object, that is to say the ball, from the ground. In golf it is necessary to pick balls up regularly, at the end of the game at each hole or off various greens throughout the golf course and this can be difficult for the elderly or for those who are no longer as agile as they once were, as they have to bend forward and down to pick the ball up from the ground. This is made even more difficult in golf as, after putting the ball into the hole, it has to be removed from the additional depth of that hole. The related set of problems have been known for a long time which means that there are already a few proposals in the state of the art to solve this problem.

WO 2005/028036 A1 shows a device for picking up that can be retrofitted in the grip end of a club. It includes spring-loaded prongs that are displaceable from a position in the grip into a position outside the grip, the said prongs being held in the grip by means of bias. The displacement movement is effected by a grasping of the prongs that are guided in a holder. The prongs include predetermined plastic deformations which make it easier for them to spring out, the displacement movement into the pivoted position being simplified by the guiding of the prongs. A similar solution without the guiding is made known in U.S. Pat. No. 3,698,720.

EP 0 453 120 B1 makes known a comparable device for picking up, where an axial compression spring is provided in addition to the spring-loaded prongs such that through cooperation between prongs and axial spring, the prongs are displaced out of the grip. An actuating element is provided on the outside of the grip to trigger this movement. However, the design with several springs makes this device expensive and increases the overall length which means that, in spite of its capability of being retrofitted, it has not been successful in the market.

A comparable solution was put forward as early as 1905 in U.S. Pat. No. 802,264, where the emphasis, however, was more on the axial spring. The axial spring extends in this case at least over half the length of the club which means that this solution is also very expensive and hardly capable of being retrofitted and consequently has to be installed by the manufacturer.

U.S. Pat. No. 1,658,145 makes known a device, which also allows for the collecting of balls by hand. Several resilient, curved prongs are provided at the end of the grip of a club, however these prongs extend permanently from the end of the golf club which means that they are obstructive, at least during play, more especially however they can also cause problems when the club has to be stowed in a golf bag.

U.S. Pat. No. 2,801,875 makes known a device for picking up that can be fastened in a retrofitting manner to the end of the grip on the outside. It is true that this retrofittable device for picking up is not so easy to lose, however it does cause problems during play and when being inserted into the golf bag. A comparable solution is currently on the market in the form of a resilient rubber element, however such a fastening on the outside of the grip means that when the player takes the club out of the bag it slackens, such that the player in the majority of cases has to take several such devices along at a time.

U.S. Pat. No. 3,318,628 makes known a golf club with a device for picking up, the device also being retractable in the grip. The displacement movement is effected by means of a button that is mounted on the side of the club, by means of which button the device can be displaced out of the retracted position into the extended position. In the extended position the prongs fold outwards on account of resilient forces, the actual displacement movement is effected, however, by means of the actuating device.

SUMMARY OF THE INVENTION

Proceeding from this state of the art, it is the object of the present invention to create a compact device for picking up that is simple to operate.

This object is achieved by a device for picking up with the features of claim 1 and by a club provided therewith with the features of claim 17.

Gripping arms are used in place of the resilient prongs, the gripping arms being displaceable into the actuating position under the force of a resilient element. At the same time they are held in their rest position by a resilient element. Consequently, a sturdy device for picking up is produced with a few favorable means, it being possible to design the device for picking up in a very compact manner and it being possible, preferably, to mount it simply on the grip and not in the grip.

The same resilient element that holds the at least one gripping arm in its actuating position is preferably also used to hold the gripping arm in its rest position under the force of the resilient element and consequently to hold the device for picking up in the closed state. In addition, the same resilient element can be disposed such that when the ball is picked up, as the opening movement increases, the spring force working on the gripping arm is increased.

The device for picking up is advantageously mounted fixedly at the grip end of the club, preferably at the grip end of a golf putter, and is easily displaceable into the open gripping position with one hand. The outside shape is adapted to the contour of the putter grip and consequently does not interfere when the player is putting. The closed device for picking up forms a closed face at the end of the grip. The open device for picking up, once the golf ball has been removed, can also be closed again with one hand. It is easily assembled on all current putter grips, for example by using three screws.

The preferred purpose of the device for picking up is for use on clubs for picking up balls and more especially golf clubs, as mentioned above.

Further advantages are produced from the sub claims and the following description.

DESCRIPTION OF PREFERRED EXEMPLIFIED EMBODIMENTS

Figure 1:
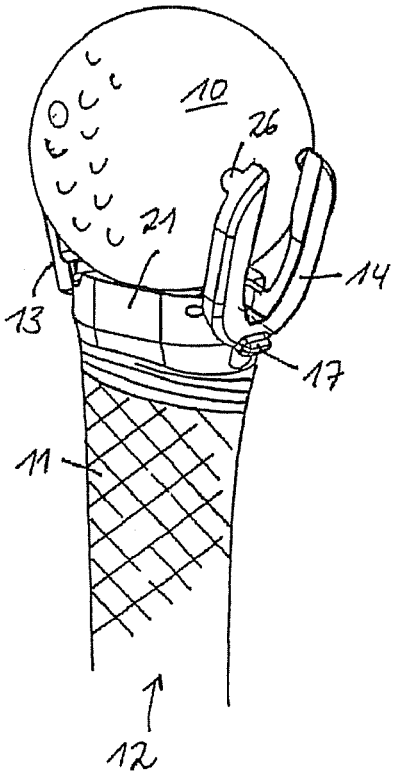
FIG. 1 is a perspective view of the end of a club with a device for picking up disposed thereon in the actuating position.

Before the invention is described in detail, it must be pointed out that it is not limited to the respective components of the device or the respective method steps, as these components and methods can vary. The terms used here are purely to describe certain specific embodiments and are not used restrictedly. If, in addition, the singular or indefinite article are used in the description or in the claims, this also refers to the plural of the said elements unless something to the contrary is definitely made clear in the overall context.

The Figs. show a device for picking up balls, more especially golf balls 10, the device being disposed or installed in the region of the grip 11 of a club 12, more especially a golf club. The club includes several holding elements, which, under the effect of at least one resilient element 15, 16, which are formed by leaf springs in the exemplified embodiment, are displaceable from a rest position on the grip into an actuatable position in which they are capable of engaging the ball. Other types of resilient elements can obviously also be used as long as they are capable of realizing a corresponding sequence of movement of the holding elements that are in the form of gripping arms 13, 14. The at least two gripping arms 13, 14 fit into each other in the rest position shown in FIG. 4 under the effect of at least one resilient element.

FIG. 1 shows a perspective view of the device for picking up with the gripping arms 13,14 open and a golf ball 10 gripped. The gripper comprises a base 21 and the at least two gripping arms that are pivotally mounted thereon, the gripping arms being formed by a single arm gripper 13 and a double arm gripper 14. It is possible to use more gripper arms, such as, for example, three or four single arm grippers. The gripper arms are preferably plastics material injection molded parts. The base 21 can be assembled on any usual putter grip using securing means such as, for example, three self-locking screws as shown in FIG. 6, preferably on the existing grip 11 without any modification being necessary to the grip.

Figure 6:
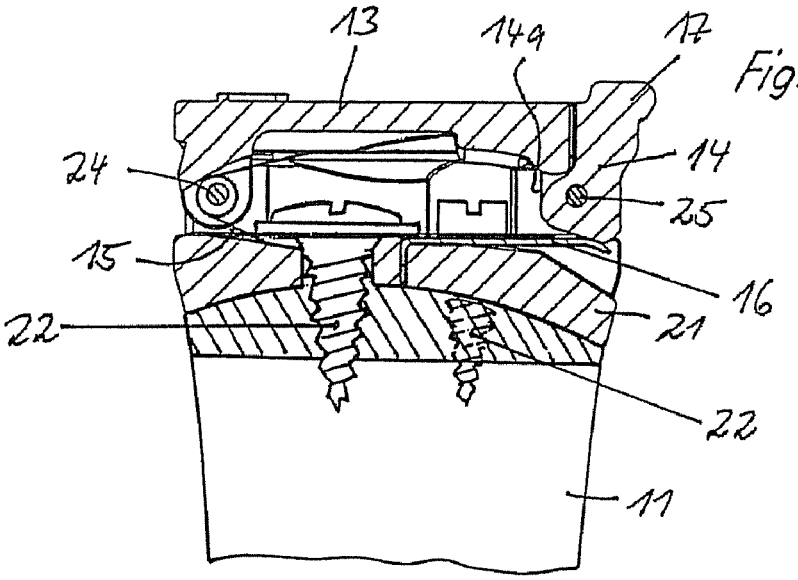
FIG. 6 is a section through the club and device for picking up according to line 6-6 in FIG. 5.
Figure 7:
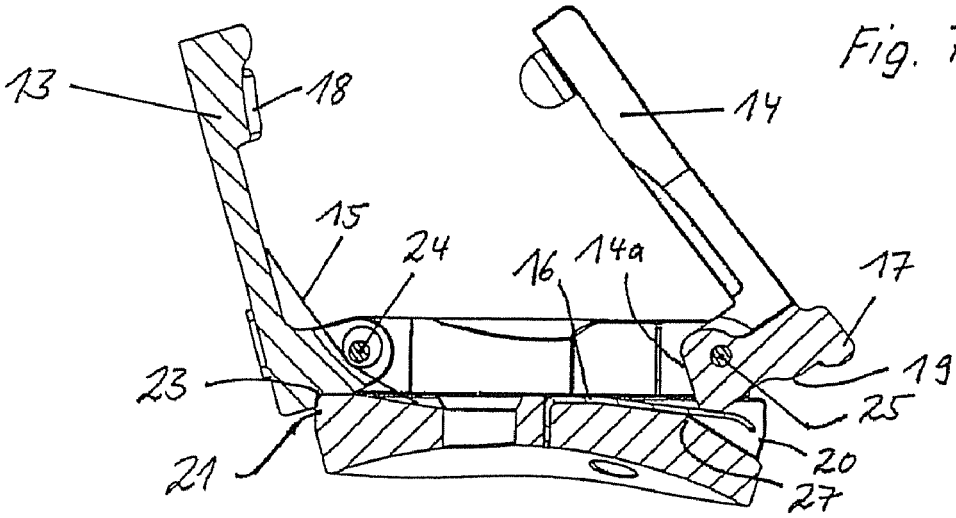
FIG. 7 is a sectional representation of the device for picking up in FIG. 6 in the course of opening with the one gripping arm in an intermediate position.

In FIGS. 6 to 9, the at least one resilient element 15, 16, which is used to displace the gripping arms 13,14 into the actuatable position, is at the same time the at least one resilient element 15, 16 for holding the gripping arms in the rest position. FIG. 6 shows a central section through the closed device for picking up. The base 21 is connected to the end of the grip 11 by securing means 22, the securing means 22 at the same time holding down and fixing the at least one resilient element 15,16, formed by leaf springs, in its closed position. FIG. 7 is a sectional representation of the opening double arm gripper 14 in an intermediate position. The single arm gripper 13 opens automatically, driven by the resilient element 15, and is fixed in its actuatable and pick-up position by the stop point 23 on the base 21. The two gripping arms are pivotally mounted by the axes 24 and 25.

Figure 8:
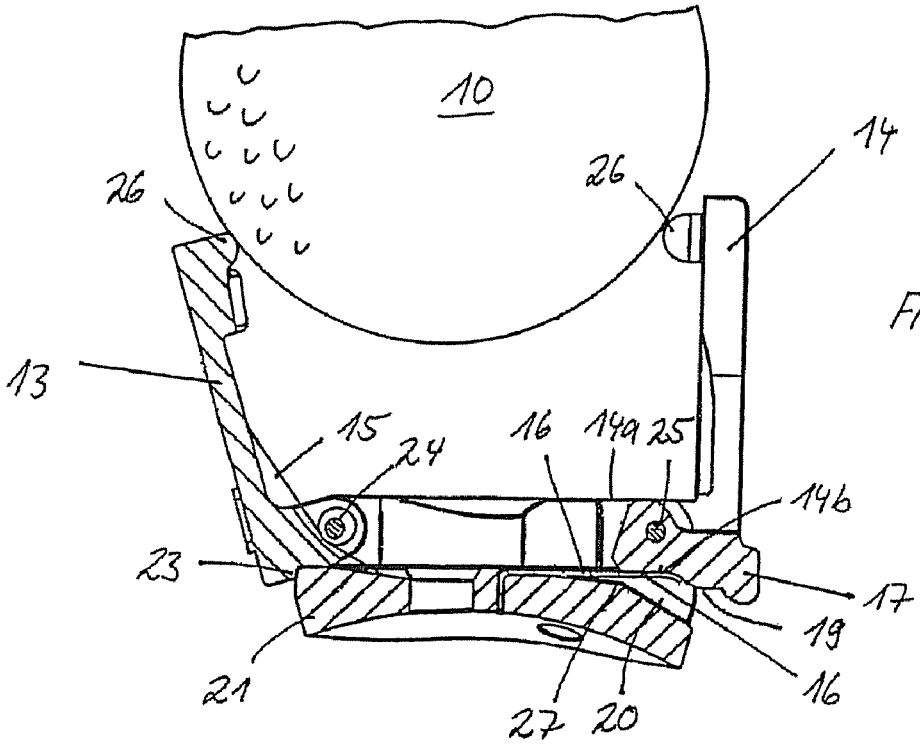
FIG. 8 is a sectional representation of the opened device for picking up in FIG. 6 when picking up a golf ball.

FIG. 8 shows the double arm gripper 14 in its position angled at a right angle, which is set on account of the force of the resilient element 16 when the triggering means 17 for the preferably single-handed triggering of the device for picking up is actuated. The movement of the gripping arms is supported by the resilient element 16. By comparing FIGS. 6 to 8 it can be seen that the resilient element 16, in the rest position, abuts against a first contact face 14*a* of the double arm gripper 14. Through the movement of the single arm gripper the double arm gripper is moved out of the rest position on account of the force of the resilient element 15 until, in the position of the double arm gripper in FIG. 8, the resilient element 16 abuts against another contact face 14*b* of the double arm gripper, such that the latter is automatically held in this actuatable position. This position is the starting position in order to be able to grip the golf ball.

Figure 2:
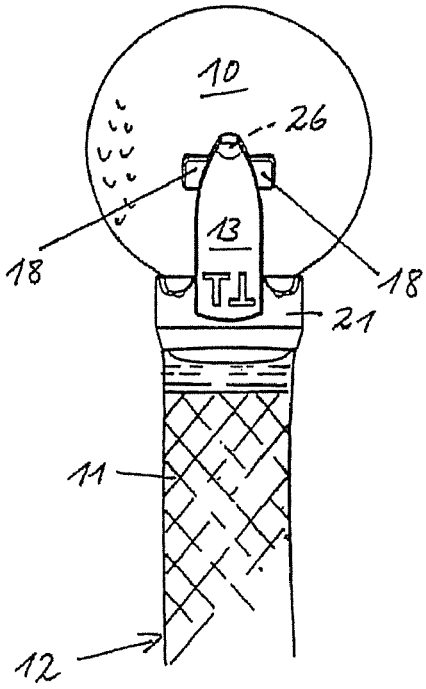
FIG. 2 is a side view of an open single arm gripper having picked up a ball.

The gripping arms hold each other in the rest position in a reciprocal manner. This is effected by means of holding elements 18, which can be seen in FIG. 2 on the open single arm gripper 13 that is abutting against the golf ball 10. The said holding elements 18 are in operative connection in the rest position with the arms of the double arm gripper 14 for holding purposes and, when the device for picking up is opened, for releasing purposes. In the embodiment they are formed by integrally molded wings of the single arm gripper 13, which in the rest position are engaged over by the arms of the double arm gripper 14, the resilient element 15 moving the double arm gripper in this position into a locking position with the triggering means 17. The wings mounted on both sides are for holding down the single arm gripper 13 in the closed state of the rest position. When the two gripping arms are closed, the U-shaped double arm gripper 14 encompasses the holding elements 18 and thereby moves the single arm gripper 13 in its rest position. The single arm gripper 13, which is continuously under spring tension, is held down by the double arm gripper 14 by means of the holding elements 18 and is prevented from springing up into its gripping position.

Figure 3:
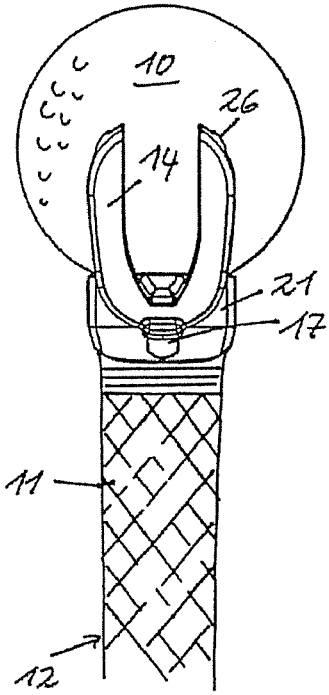
FIG. 3 is a side view of an open double arm gripper having picked up a ball.

FIG. 3 shows the open double arm gripper 14. At the end of the gripping arm there are spherical elevations 26, which together form a 3 point pick-up, by means of which the ball, picked-up, is fixed and held under tension.

Figure 4:
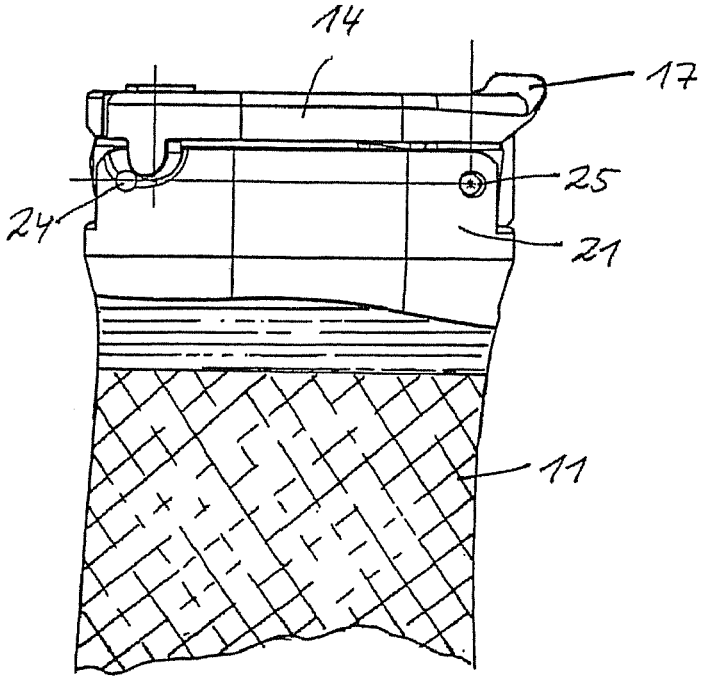
FIG. 4 is a side view of the device for picking up in the rest position.

FIG. 4 shows the closed device for picking up in its rest position. The triggering means 17 can be seen on the top right-hand side on the double arm gripper 14 and when the said triggering means are actuated, the gripping arms are moved. At the same time the single arm gripper is also opened.

Figure 5:
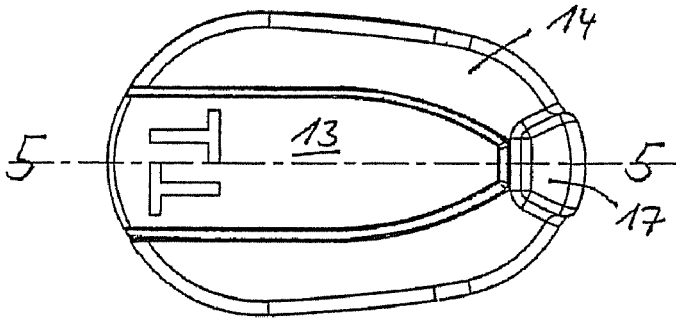
FIG. 5 is a top view of the grip in a representation according to FIG. 4.

FIG. 5 shows a top view of the closed device for picking up. The outside shape is adapted to the contour of the grip 11. In this rest position, the gripping arms 13, 14 form a face on the shaft of the grip 11, the face not interfering with the operation of the club 12, the projection of the device for picking up in its rest position in the direction of the shaft of the grip (11) corresponding approximately to the contour of the shaft.

At least one and preferably the two gripping arms are angled in the region of their bearing arrangement, preferably about 90°. The L-shaped development of the gripping arms, once pivoted into the actuatable position, creates an enlargement of the gripping area provided, such that, in spite of the tight space at the end of the grip 11 of the club 12, it is possible to grip a golf ball.

Figure 9:
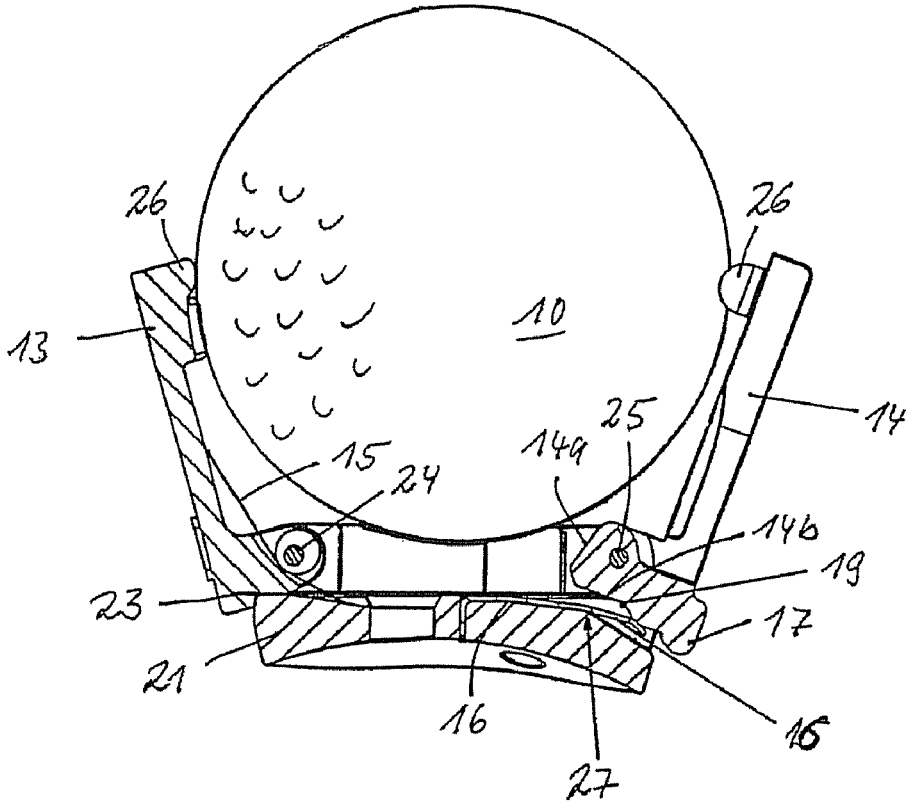
FIG. 9 is a sectional representation of the opened device for picking up in FIG. 6 having picked up a golf ball.

FIG. 9 is a sectional representation of the device for picking up gripping a golf ball. As the golf ball 10 is immersed further and further into the holding position, the double arm gripper 14 is moved further and further outwards. In this case, the resilient element 16 that is accommodated in the accommodating channel 20 is pressed further downwards by means of the protrusion 19. The resilient element 16 abutting against the protrusion 19 consequently already increases the force of the resilient element and consequently the holding force of the gripping arm. Once the break point 27 is reached, the spring force is increased as the pivot movement continues and the force onto the double arm gripper 14 is thereby increased. This means that the accommodating channel 20 is formed such that, when a predetermined pivotal angle of the gripping arm into the actuatable position is exceeded, the lever arm of the resilient element 16 is decreased by increasing the force of the resilient element. This measure generates a sufficiently large holding force in order to be able to hold the gripped ball in a reliable manner.

Consequently at least one of the gripping arms, preferably the double arm gripper 14, holds the picked-up golf ball between the gripping arms under the force of at least one resilient element 15, 16. In the embodiment the at least one resilient element 15, 16 for holding the golf ball between the gripping arms is at the same time the at least one resilient element 15, 16 for holding the gripping arms in the rest position and also the at least one resilient element 15, 16 for displacing the gripper arms 13, 14 into the actuatable position.

The resilient element 16, in the form of the leaf springs, has three functions, these are 1.) to hold the double arm gripper 14 closed under spring force in its rest position, 2.) to hold the double arm gripper 14 in its open position automatically in a position approximately at a 90° angle and 3.) to apply increased spring force as the picking up movement of the ball develops and the opening movement gets wider.

The device for picking up is distinguished in that it is mounted fixedly at the grip end of a golf putter and it can easily be moved into the open gripping position with one hand. After the golf ball has been removed, the open gripper can also be closed again with one hand. It is easily assembled on all current putter grips.

The preferred application of the device for picking up is on clubs for picking up balls and in this case more especially golf clubs, as mentioned above.

LIST OF REFERENCES

10 Golf ball
11 Grip
12 Club
13,14 Gripping arms
14*a* First contact face
14*b* Additional contact face
15,16 Resilient element
17 Triggering means
18 Holding element
19 Protrusion
20 Accommodating channel
21 Base
22 Securing means
23 Contact point
24,25 Axis
26 Elevation
27 Break point

The invention claimed is:

1. Device for picking up balls or golf balls, the device being disposed or installed on a base at the end of a grip of a club or a golf club, and the device including a plurality of holding elements, which are displaceable under the effect of at least one resilient element from a rest position on the base into an actuatable position in which they are capable of engaging the ball, wherein the holding elements are at least two gripping arms, wherein, in the rest position, one of the at least two gripping arms is nested within a recess of another of the at least two gripping arms under the effect of at least one resilient element, wherein the base is mounted on a closed end of the existing grip.

2. Device for picking up according to claim 1, wherein the at least one resilient element for displacing the at least two gripping arms into the actuatable position is at the same time the at least one resilient element for holding the gripping arms in the rest position.

3. Device for picking up according to claim 1, wherein, in their rest position, the at least two gripping arms form a face on the shaft of the grip, the face not interfering with the operation of the club.

4. Device for picking up according to claim 1, wherein a projection of the periphery of the device for picking up in its rest position in the direction of a shaft of the grip corresponds approximately to the contour of the shaft.

5. Device for picking up according to claim 1, wherein a triggering means is provided for triggering the device for picking up with one hand.

6. Device for picking up according to claim 1, wherein the at least two gripping arms are formed by a single arm gripper and a double arm gripper, which hold each other in position in the rest position.

7. Device for picking up according to claim 6, wherein the single arm gripper includes holding elements, which, in the rest position, are in operative connection with the double arm gripper for holding purposes and when the device for picking up is open for releasing purposes.

8. Device for picking up according to claim 6, wherein the holding elements are formed by wings of the single arm gripper, which, in the rest position, are engaged over by the arms of the double arm gripper, wherein the resilient element moves the double arm gripper in this position into a locked position with the triggering means.

9. Device for picking up according to claim 1, wherein at least one of the gripping arms is angled in the region of its bearing arrangement.

10. Device for picking up according to claim 9, wherein the at least one gripping arm is angled about 90°.

11. Device for picking up according to claim 1, wherein the device is secured on the existing grip of the club.

12. Device for picking up according to claim 1, wherein at least one of the gripping arms holds the ball that has been picked up between the gripping arms under the force of at least one resilient element.

13. Device for picking up according to claim 12, wherein the at least one gripping arm is a double arm gripper.

14. Device for picking up according to claim 12, wherein the at least one resilient element for holding the golf ball between the gripping arms is at the same time at least one of the at least one resilient elements, which encompass the at least one resilient element for holding the gripping arms in the rest position and the at least one resilient element for displacing the gripping arms into the actuatable position.

15. Device for picking up according to claim 1, wherein at least one gripping arm includes a protrusion, the abutting of which against the resilient element increasing the force of the resilient element and consequently the holding force of the gripping arm.

16. Device for picking up according to claim 1, wherein the resilient element is disposed in an accommodating channel, which is shaped such that when a predetermined pivotal angle of the gripping arm into the operating position is exceeded, a lever arm of the resilient element is deformed by increasing the force upon the resilient element by the gripping arm.

17. Club for picking-up balls, wherein the club includes a device for picking up balls or golf balls, the device being disposed or installed on a base at the end of a grip of the club and including a plurality of holding elements, which are displaceable under the effect of at least one resilient element from a rest position on the base into an actuatable position in which they are capable of engaging the ball, wherein the holding elements are at least two gripping arms, wherein, in the rest position, one of the at least two gripping arms is nested within a recess of another of the at least two gripping arms under the effect of at least one resilient element, wherein the base is mounted on a closed end of the existing grip.

18. Club for picking up according to claim 17, wherein the at least one resilient element for displacing the at least two gripping arms into the actuatable position is at the same time the at least one resilient element for holding the gripping arms in the rest position.

19. Club for picking up according to claim 17, wherein, in their rest position, the at least two gripping arms form a face on the shaft of the grip, the face not interfering with the operation of the club.

20. Club for picking up according to claim 17, wherein a projection of the periphery of the device for picking up in its rest position in the direction of a shaft of the grip corresponds approximately to the contour of the shaft.

21. Club for picking up according to claim 17, wherein a triggering means is provided for triggering the device for picking up with one hand.

22. Club for picking up according to claim 17, wherein the at least two gripping arms are formed by a single arm gripper and a double arm gripper, which hold each other in position in the rest position.

23. Club for picking up according to claim 22, wherein the single arm gripper includes holding elements, which, in the rest position, are in operative connection with the double arm gripper for holding purposes and when the device for picking up is open for releasing purposes.

24. Club for picking up according to claim 22, wherein the holding elements are formed by wings of the single arm gripper, which, in the rest position, are engaged over by the arms of the double arm gripper, wherein the resilient element moves the double arm gripper in this position into a locked position with the triggering means.

25. Club for picking up according to claim 17, wherein at least one of the gripping arms is angled in the region of its bearing arrangement.

26. Club for picking up according to claim 17, wherein at least one of the gripping arms holds the ball that has been picked up between the gripping arms under the force of at least one resilient element.

27. Club for picking up according to claim 26, wherein the at least one resilient element for holding the golf ball between the gripping arms is at the same time at least one of the at least one resilient elements, which encompass the at least one resilient element for holding the gripping arms in the rest position and the at least one resilient element for displacing the gripping arms into the actuatable position.

28. Club for picking up according to claim 17, wherein at least one gripping arm includes a protrusion, the abutting of which against the resilient element increasing the force of the resilient element and consequently the holding force of the gripping arm.

29. Club for picking up according to claim 17, wherein the resilient element is disposed in an accommodating channel, which is shaped such that when a predetermined pivotal angle of the gripping arm into the operating position is exceeded, a lever arm of the resilient element being deformed by increasing the force upon the resilient element by the gripping arm.

30. Club according to claim 17, wherein the said club is a golf club.

31. Device for picking up balls or golf balls, the device being disposed or installed on a base at the end of a grip of a club or a golf club, and the device including a plurality of holding elements, which are displaceable under the effect of at least one resilient element from a rest position on the base into an actuatable position in which they are capable of engaging the ball, wherein the holding elements are at least two gripping arms, which, in the rest position, are fitted into each other under the effect of at least one resilient element, wherein the base is mounted on the existing grip, wherein the at least two gripping arms are formed by a single arm gripper and a double arm gripper, which hold each other in position in the rest position, and wherein the single arm gripper includes holding elements, which, in the rest position, are in operative connection with the double arm gripper for holding purposes and when the device for picking up is open for releasing purposes.

32. Device for picking up balls or golf balls, the device being disposed or installed on a base at the end of a grip of a club or a golf club, and the device including a plurality of holding elements, which are displaceable under the effect of at least one resilient element from a rest position on the base into an actuatable position in which they are capable of engaging the ball, wherein the holding elements are at least two gripping arms, which, in the rest position, are fitted into each other under the effect of at least one resilient element, wherein the base is mounted on the existing grip, wherein at least one gripping arm includes a protrusion, the abutting of which against the resilient element increasing the force of the resilient element and consequently the holding force of the gripping arm.

* * * * *